US010287090B2

(12) United States Patent
Hill et al.

(10) Patent No.: US 10,287,090 B2
(45) Date of Patent: May 14, 2019

(54) PACKAGE FOR TOBACCO PRODUCTS OR TOBACCO RELATED COMMODITIES OR SMOKING DEVICES AND USE THEREOF

(71) Applicant: REEMTSMA CIGARETTENFABRIKEN GMBH, Hamburg (DE)

(72) Inventors: Tony Hill, Hamburg (DE); Björn Urban, Hamburg (DE)

(73) Assignee: REEMTSMA CIGARETTENFABRIKEN GMBH, Hamburg (DE)

( * ) Notice: Subject to any disclaimer, the term of this patent is extended or adjusted under 35 U.S.C. 154(b) by 356 days.

(21) Appl. No.: 15/031,161

(22) PCT Filed: Aug. 26, 2014

(86) PCT No.: PCT/EP2014/068076
§ 371 (c)(1),
(2) Date: Apr. 21, 2016

(87) PCT Pub. No.: WO2015/058888
PCT Pub. Date: Apr. 30, 2015

(65) Prior Publication Data

US 2016/0264345 A1 Sep. 15, 2016

(30) Foreign Application Priority Data

Oct. 22, 2013 (EP) ..... 13005033

(51) Int. Cl.
*B65D 85/10* (2006.01)
*B65D 85/12* (2006.01)
(Continued)

(52) U.S. Cl.
CPC ..... *B65D 85/1045* (2013.01); *A24F 15/00* (2013.01); *B65D 5/38* (2013.01);
(Continued)

(58) Field of Classification Search
CPC ..... B65D 5/38; B65D 85/10; B65D 85/1045; B65D 2313/04
(Continued)

(56) References Cited

U.S. PATENT DOCUMENTS 1,450,674 A * 4/1923 Marston ..... A45C 7/0031 131/242
2,929,542 A 3/1960 O'Gorman
(Continued)

FOREIGN PATENT DOCUMENTS

CN 102712383 A 10/2012
CN 202557913 U 11/2012
(Continued)

OTHER PUBLICATIONS

Office Action for Australian Patent Application 2014339321 dated Jul. 4, 2017, 3 pages.
(Continued)

*Primary Examiner* — Luan K Bui
(74) *Attorney, Agent, or Firm* — Workman Nydegger

(57) ABSTRACT

A package for tobacco products or tobacco related commodities or smoking devices, including an openable closure with at least two walls sliding over another when the closure is being opened and closed, at least the one wall includes a sequence of magnetic elements, extending in the direction of the relative movement of the two walls when they slide over another and having alternating positive and negative poles, and that the other wall includes at least one magnetic element with a magnet pole, which slides along the magnetic elements of the one wall when the two walls slide over another. Methods of use are also described.

20 Claims, 3 Drawing Sheets

(51) Int. Cl.
*A24F 15/00* (2006.01)
*B65D 5/38* (2006.01)

(52) U.S. Cl.
CPC ..... *B65D 85/10* (2013.01); *B65D 85/12* (2013.01); *B65D 2313/04* (2013.01)

(58) Field of Classification Search
USPC ..... 206/242, 248, 261, 468, 804, 818; 220/230, 345.1–345.3
See application file for complete search history.

(56) References Cited

U.S. PATENT DOCUMENTS

| | | | | |
|---|---|---|---|---|
| 3,388,706 | A * | 6/1968 | Muirheid | A24F 15/18 131/238 |
| 3,468,576 | A * | 9/1969 | Beyer | E05C 19/16 220/230 |
| 3,881,599 | A | 5/1975 | Flaherty | |
| 3,897,288 | A | 7/1975 | Fayling | |
| 4,427,481 | A | 1/1984 | Smith et al. | |
| 4,693,775 | A | 9/1987 | Harrison et al. | |
| 4,835,624 | A | 5/1989 | Black et al. | |
| 5,762,263 | A | 6/1998 | Chamberlain, IV | |
| 6,127,002 | A | 10/2000 | Callahan, Jr. et al. | |
| 6,774,171 | B2 | 8/2004 | Kassa et al. | |
| 6,790,378 | B2 | 9/2004 | Graham et al. | |
| 6,831,541 | B1 | 12/2004 | Seidler | |
| 7,128,798 | B2 | 10/2006 | Boudouris et al. | |
| 7,338,573 | B2 | 3/2008 | Boudouris et al. | |
| 7,422,018 | B2 * | 9/2008 | Dieudonat | A45D 40/221 132/294 |
| 7,451,879 | B2 * | 11/2008 | Ford | B65D 11/12 206/461 |
| 7,501,921 | B2 | 3/2009 | Richards et al. | |
| 7,681,727 | B2 | 3/2010 | Hunt et al. | |
| 7,866,466 | B2 | 1/2011 | Rose et al. | |
| 2004/0206638 | A1 * | 10/2004 | Metzler | B65D 5/721 206/1.5 |
| 2009/0261093 | A1 * | 10/2009 | Fullerton | B25H 3/021 220/4.28 |
| 2010/0032403 | A1 * | 2/2010 | Hajichristou | B65D 43/0225 215/337 |
| 2011/0147243 | A1 | 6/2011 | Chatelain | |
| 2012/0261286 | A1 * | 10/2012 | Holloway | B65D 85/1054 206/268 |

FOREIGN PATENT DOCUMENTS

| | | |
|---|---|---|
| DE | 2551427 | 5/1977 |
| EP | 243663 | 11/1987 |
| EP | 0452068 | 10/1991 |
| EP | 1219118 | 1/2004 |
| EP | 1792848 | 6/2007 |
| EP | 1836108 | 9/2007 |
| EP | 1923330 | 5/2008 |
| EP | 2143663 | 1/2010 |
| EP | 2325093 | 5/2011 |
| EP | 1626916 | 9/2014 |
| EP | 2813440 | 12/2014 |
| EP | 2815989 | 12/2014 |
| RU | 2434800 C1 | 11/2011 |
| WO | WO 2006/061563 | 6/2006 |
| WO | WO 2006/089926 | 8/2006 |
| WO | WO 2007/029528 | 3/2007 |
| WO | WO 2007/144043 | 12/2007 |
| WO | WO 2010/063569 | 6/2010 |
| WO | WO 2011/147243 | 1/2011 |
| WO | WO 2011/060795 | 5/2011 |
| WO | WO 2011/072806 | 6/2011 |
| WO | 2012/058413 A2 | 5/2012 |
| WO | 2012058413 A2 | 5/2012 |
| WO | WO 2012/058413 | 5/2012 |
| WO | WO 2012/119611 | 9/2012 |
| WO | 2013/110412 A1 | 8/2013 |
| WO | 2013110412 A | 8/2013 |
| WO | WO 2013/110412 | 8/2013 |
| WO | WO2013/110412 A1 | 8/2013 |

OTHER PUBLICATIONS

International Search Report and Written Opinion for PCT Application No. PCT/EP2014/068076, dated Oct. 30, 2014.
Office Action and Translation for RU 2016115766 dated Sep. 19, 2017, 11 pages.
Office Action in Corresponding Canadian Patent Application 2928052 dated Oct. 9, 2018, 6 pages.
Office Action in Corresponding Japanese Application 2016-525562 dated Nov. 1, 2018, 6 pages.

* cited by examiner

PACKAGE FOR TOBACCO PRODUCTS OR TOBACCO RELATED COMMODITIES OR SMOKING DEVICES AND USE THEREOF

CROSS-REFERENCE TO RELATED APPLICATIONS

This application is a U.S. Nationalization of PCT Application Number PCT/EP2014/068076, filed on Aug. 26, 2014, which claims priority to European Patent Application No. 13005033.9, filed on Oct. 22, 2013, the entireties of which are incorporated herein by reference.

The present disclosure relates to a package for smokeable or non-smokeable tobacco products, in particular raw tobacco, cigarettes or snus, or smokeable or non-smokeable tobacco related commodities, in particular cigarette paper, filters, tubes or filter tubes for cigarettes, or electronic or non-electronic smoking devices, in particular electronic cigarettes or aerosol-generating devices.

BACKGROUND

Packaging tobacco products or tobacco related commodities or smoking devices in particular into bags, folding boxes and cans is known. The known packages have closures in the form of pivotal or detachable caps, inner parts which can be drawn out or swung out, or detachable can lids. The closures are kept in the closed position by clamping or by a pressure-sensitive adhesive. In the opened condition, they are not fixed in a certain position so that the opening cross section is variable or a detachable closure can be lost.

The document WO 2012/119611 A1 describes a package for tobacco-related commodities, which comprises a box with a bottom wall and side walls extending from the bottom wall. The outer box has at least partially a polygonal and/or round diameter, encloses an inner space and has an opening in front of the bottom wall or one of the side walls. A permanent magnet is undetachably (e.g., permanently) fixed in the inner space. The package can be magnetically fixed on different objects, for instance on the door of a refrigerator, a metallic door frame, lampholder or table, and thus it can be easily found again and be stored at a preferred place.

The document WO 2012/058413 A2 describes a package assembly for accommodating and dispensing a plurality of elongate consumable products and chewing gum. A first accommodation compartment and a second accommodation compartment for products are connected via a hinge. Each accommodation compartment has an open end adjacent the said hinge, wherein the product accommodation compartments are foldable about the hinge in a book-like fashion to open and close thereabout. In addition, the package assembly comprises essentially elongate, planar magnetic strips, which contain elongate magnetizable particles aligned in a carrier. The particles are magnetizable to define positive and negative charges on opposite surfaces of the strip. The positive and negative charges are arranged in spaced-apart alternating columns along the opposite surfaces of the planar strip. One such strip is positioned on each accommodation compartment, so that upon foldably closing the compartments, a positively charged column of one surface of a planar strip is in juxtaposition with a negatively charged column of the other surface of the other planar strip when the accommodation compartments are folded together, and the planar strips become aligned to each other under magnetic attraction. The package is held in a defined closed position by the magnetic strips.

SUMMARY

One or more embodiments of the present disclosure may provide a package for tobacco products or tobacco related commodities with more favourable usage properties.

The objective may be achieved by a package having the features of claim 1. Advantageous embodiments of the disclosure are indicated in the dependent claims.

The package for tobacco products or tobacco related commodities or smoking devices of the present disclosure comprises an openable closure with at least two walls sliding over another when the closure is being opened and closed, at least the one wall comprises a sequence of magnetic elements, extending in the direction of the relative movement of the two walls when they slide over another and having alternating positive and negative poles, and that the other wall comprises at least one magnetic element with a magnet pole, which slides along the magnetic elements of the one wall when the two walls slide over another.

In the package of the present disclosure, magnetic forces are effective between the magnetic elements of the one wall and the other when the closure is opened and closed. So, the user must overcome the magnetic forces when he opens or closes the closure. Because of the magnetic forces, the user can better control opening and closing of the closure. Through this, the closure is better secured against unintended opening and closing.

According to an embodiment, the arrangement of the magnetic elements is such that the openable closure can be fixed in different positions by the magnetic elements. Preferably, it can be fixed in a closed position and in one or several opened positions to take out good from the package. Through this, a safe closure is made possible which can be opened and closed as often as will and which can be brought into a secured closed- and into one or several secured opened positions. In the closed position, the closure is better secured against unintended opening. In the secured opened positions, the contained good can be taken out and put in again more safely, as the case may be. According to an advantageous embodiment, the closure can be fixed at least in one closed position, in which the good cannot be taken out of the package, and in an opened position, in which the good can be taken out of the package; in the opened position, the closure can also have a securing function, which prevents unintended falling out of products. By way of example, a cap flapped away in a certain position can prevent cigarettes from slipping out of a shell, but permit the intended take-out by swinging out single cigarettes. According to a further embodiment, in a cigarette packet, the openable closure can be brought into an opened position in which it exposes only one row of cigarettes, so that the remaining rows are covered up. Through this, the cigarettes in the covered rows are protected against contact with the hand of the user, unintended drawing out and falling out of the package. In addition, the exchange of flavours and humidity with the surroundings is restricted. Thus, fixing the closure in a partially opened position is advantageous under the aspects of hygiene, handling and preservation of flavour and taste of the products. According to a further embodiment, the closure can be fixed in several opened positions, in which openings having different sizes are exposed. This permits the user to adjust the size of the opening according to the present filling condition of the package. In addition, the loss of a closure that is detachable from the package can be prevented by securing the closure in at least one opened position.

According to a preferred embodiment, the arrangement of the magnetic elements is such that a ratching (e.g., ratcheting) or other sound, perceivable by the user, is generated when the two walls slide along each other. The sound is generated in that a magnetic element or a sequence of magnetic elements with alternating positive and negative poles slides along a sequence of magnetic elements with positive and negative poles. The sound depends on the distance and the dimensions of the magnetic elements, the magnetic field strength of the magnetic elements, the material and the thickness of the walls on which the magnetic elements are arranged, and the velocity of the sliding along of the walls.

The magnetic elements typically generate a clearly perceivable ratching (e.g., ratcheting) when the closure is opened and/or closed. With the aid of the sound, the user can better control opening and closing of the closure. Additionally, this haptic or tactile effect when opening and closing the closure can make the package more attractive.

According to a further embodiment, both walls have a sequence of magnetic elements with alternating positive and negative poles, extending in the direction of the relative movement of the two walls when they are being opened. This is advantageous for safe fixation of the closure in different positions and for generating a sound upon opening and closing the package.

According to a further embodiment, each sequence consists of elongate magnetic elements, which are aligned crosswise to the direction of the relative movement of the two walls. This is advantageous for magnetic elements with magnetic field strengths sufficiently strong to fix the closure in different positions and to generate a well perceivable sound upon opening and closing the closure. The magnetic elements extend preferably parallel to each other.

According to a further embodiment, the magnetic elements have a straight or zigzag shaped or curved or sinusoidal or differently curved course. The magnetic elements are preferably straight or arbitrarily curved strips.

Furthermore preferably, the magnetic elements extend vertical to the direction of the relative movement of the two walls.

According to a preferred embodiment, the neighbouring magnetic elements have a constant distance from each other in each sequence. The distance is according to one embodiment 0.1 to 5 mm, preferably 0.5 to 2 mm, still preferably 1 mm. According to one embodiment, the magnetic elements have a width of 0.1 to 0.5 mm, preferably 0.5 to 2 mm, still preferably 1 mm. According to one embodiment, the magnetic elements have a length of 0.5 to 100 mm, preferably 1 to 75 mm, still preferably 2 to 50 mm, still preferably 5 to 10 mm.

According to a further embodiment the neighbouring magnetic elements have a progressively smaller or larger getting dimension (width and/or length) in the direction of the relative movement of the two walls, or a progressively smaller or larger getting distance from each other in each sequence with respect to the direction of the relative movement of the two walls, wherein at least one sequence comprises at least 3 magnetic elements. With the aid of the characteristic sound change, the user can better control opening and closing of the closure.

According to a further embodiment, the one wall comprises the sequence of magnetic elements on the side of the other wall and the other wall comprises at least one magnetic element on the side of the one wall.

According to a further embodiment, the magnetic elements are arranged on sides of the one and the other wall which face each other. As a consequence, a particularly strong magnetic field strength is effective between the magnetic elements of the one and the other wall, which is advantageous for fixing the closure in different positions and generating a sound upon opening and closing.

According to a preferred embodiment, the areas from north to south pole of the magnetic elements are arranged perpendicular to the one wall and the other wall.

According to one embodiment, the magnetic elements are permanent magnetic elements (permanent magnets).

According to a further embodiment, the one wall and the other wall have a magnetic coating comprising the magnetic elements. According to a preferred embodiment, the coating is formed by a carrier material containing the magnetic particles. The application of a magnetic coating to the walls has advantages in the production. According to a preferred embodiment, the coating is formed by an extrudable application. According to a preferred embodiment, the coating has an adhesive bond to the wall of the package. The adhesive bonding is preferably effected by an adhesive which forms the carrier material or is contained in the carrier material. According to a further embodiment, the coating is coloured. According to a further embodiment, the coating contains magnetic particles which can be aligned to a sequence of magnetic elements with alternating polarity by means of a suitable magnetization device after the coating has been applied to the walls. According to a further embodiment, the coating is extrudable. According to a further embodiment, the coating has a layer thickness of 5-100 μm, preferably 10-90 μm, further preferably 30 μm.

A material which is suited for the production of the magnetic coating is commercialized by the company Amcor under the product designation "Magnetcoat 6.1".

Many further materials can be used for the magnetic coating of the two walls sliding over another, which are described in the document WO 2012/058413 A2 on page 4, row 31 to page 6, row 25. In this respect, reference is made to WO 2012/058413 A2, whose subject matter is hereby incorporated into the present application by reference in its entirety.

For the magnetic coating, materials can be used in particular which are described in one of the following patent publications: U.S. Pat. Nos. 3,897,288, 4,427,481, 4,693,775, 4,835,624, 5,762,263, 6,127,002, 6,774,171, 6,790,378, 7,128,798, 7,338,573, 7,501,921. In this respect, reference is made to the patent publications mentioned above, whose subject matter is hereby incorporated into the present application by reference in their entireties.

According to an alternative embodiment, the magnetic elements are discrete magnets, which are bonded to the walls that slide over another. In this embodiment, the walls are provided with conventional magnets. They are preferably permanent magnets. The magnets can also be applied to carriers which are connected to the walls.

The present application can be utilized in different kinds of the package. According to a preferred embodiment, the package is a box with a pivotal or detachable cap, wherein the magnetic elements are arranged on one wall of the box, and on one wall of the cap sliding along the wall when the box is being opened. A folding box of this kind can in particular be formed such like described in the following patent publications: U.S. Pat. No. 2,929,542, EP 2 325 093, WO 2007/144043, EP 0 452 068, EP 1 923,330, EP 1 626 916, EP 1 219 118, WO2011/060795, WO 2006/089926, EP 1 792 848, WO 2011/072806, WO 2010/063569, DE 2 551 427. In this respect, reference is made to the patent publications mentioned above, whose subject matter is hereby incorporated into the present application by reference in their entireties.

According to a further embodiment, the package is a box with an inner part which can be pushed out, drawn out or folded out of an outer part, wherein the magnetic elements are arranged on one wall of the outer part and on one wall of the inner part, which slide along each other when the inner part is moved out of the outer part. The inner part can in particular be a drawer-like carrier for goods which can be drawn out or folded out of an envelope. A folding box of this kind can in particular be formed such like described in the following publications: W02006/061563, U.S. Pat. No. 2,929,542, WO 2007/029528, WO 2007/144043, EP 2 143 663, U.S. Pat. No. 3,881,599, EP 1 836 108, U.S. Pat. No. 7,681,727, EP 1 626 916, U.S. Pat. No. 7,866,466, WO 2011/147243. In this respect, reference is made to the patent publications mentioned above, whose subject matter is hereby incorporated into the present application by reference in their entireties.

According to a further embodiment, the package is a can with a can lower part and a can lid, detachable from the lower part, wherein the magnetic elements are arranged on a wall of the can lower part and a wall of the can lid which slides along it upon detaching. The can lid can in particular be a can lid that can be stripped off from the can lower part, or a can lid which can be twisted off from the can lower part. A detachable can lid has preferably a clamping seat on the can lower part. A can lid for twisting off is connectible to the can lower part for instance via a screw thread or via a bayonet catch.

Cans that are suitable for the usage in the present disclosure are described in particular in the documents EP 1 317 2340 and EP 1 317 2195. In this respect, reference is made to the patent publications mentioned above, whose subject matter is hereby incorporated into the present application by reference in their entireties.

According to a preferred embodiment, the package consists of cardboard and/or corrugated cardboard and/or plastics and/or metal.

According to a preferred embodiment, the package is a folding box from cardboard. In addition, the folding box can have an inner lining by an aluminium sheet, plastics sheet or another sheet material. Further, the folding box can be encased at the outside by a cellophane sheet or a plastic sheet with tear strip(s).

The present disclosure is further related to the utilization of a package

In the utilization according to the present disclosure, the openable closure is adjusted to different selectable positions, and fixed by the magnetic elements in the respective set position. In that the closure can be fixed in different adjustable positions, the handling is facilitated.

According to a further embodiment, opening and closing the openable closure is controlled with the aid of a ratching (e.g., ratcheting) or other sound which is generated by the magnetic elements in the walls sliding over another. The control over the opening and closing action is improved through this.

BRIEF DESCRIPTION OF THE DRAWINGS

The present invention is explained in more detail in the following by way of the attached drawings of examples of its realization. While some of the drawings may be schematic or exaggerated representations of concepts, at least some of the drawings may be drawn to scale. The drawings show.

DETAILED DESCRIPTION

In the following description, coincidentally designated parts of different realization examples are provided with the same reference signs.

The designations "top" and "bottom" refer to a folding box which is put on a horizontal ground with its bottom wall.

Figure 1B:
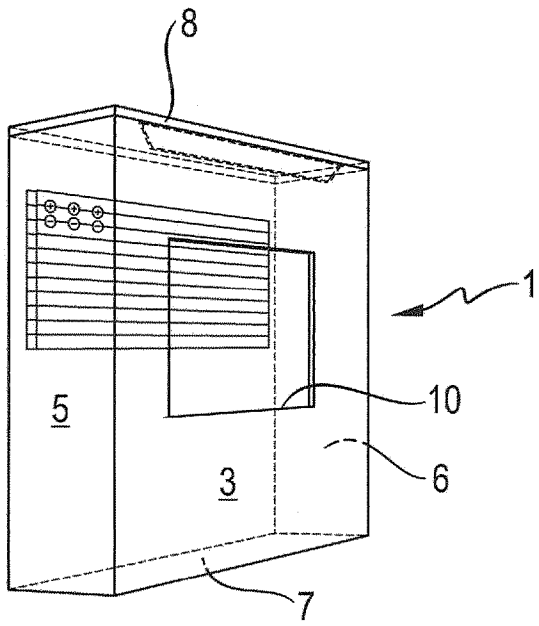
FIG. 1 a folding box with foldable flap on the outer part, and an inner part that can be drawn out of the outer part, in the opened position (FIG. 1*a*) and in the closed position (FIG. 1*b*), always in a perspective view from the front and from the left side.
Figure 1A:
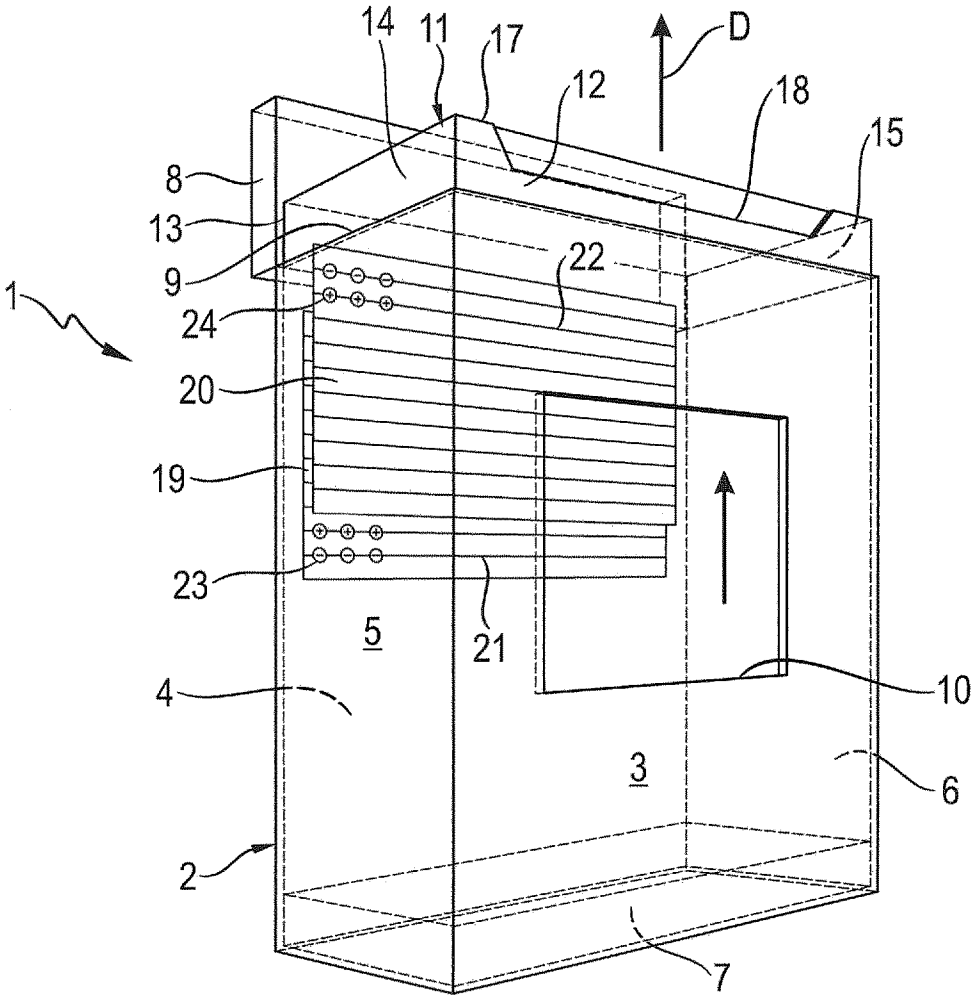

The folding box 1 of FIG. 1 has a prism-shaped outer part 2 of cardboard, which comprises four first side walls 3, 4, 5, 6. The first front and first rear side walls 3, 4 are broader than the first left and right side walls 5, 6. Further, the outer part 2 has a first bottom wall 7 and a closure 8 in the form of a cap hinged to the upper edge of the first rear side wall 4 for covering a first opening 9 of the outer part 2. A window 10 is punched out in the first front wall 3. A prismatic inner part 11 is inserted into the outer part 2. The inner part 11 has a second front and a rear side wall 12, 13, and narrower second left and right side walls 14, 15. At the bottom, the inner part 11 is closed by a second bottom wall 16. The inner part 11 has a second opening 17 at the topside. The second front side wall 12 has a well-shaped punching (e.g., indentation) 18 at the upper edge, which facilitates access to goods which may be arranged in the inner part 11.

The inner part 11 is preferably packed with cigarettes, jackets or other elongate products.

The user can engage into the window 10 with its thumb and thrust the inner part 11 in the outer part 2 upward. Through this, the cap 8 is swung up. Thereafter, the user can take out cigarettes.

A folding box of this kind is described in particular in the documents EP 2 325 093, U.S. Pat. No. 2,929,542 and WO 2007/144043, which are hereby incorporated by references in their entireties.

In addition, the first rear side wall 4 is provided with a first magnetic coating 19 on the inner side, and the second rear side wall 13 is provided with a second magnetic coating 20 on the outer side. The first coating 19 contains first magnetic elements 21, and the second coating 20 second magnetic elements 22. The magnetic elements 21, 22 are each aligned in a sequence with alternating positive and negative poles in the direction D of the relative movement of the inner part 11 relative to the outer part 2. The magnetic elements 21, 22 are straight lines or strips, extending crosswise to the direction D. Each line-shaped magnetic element 21, 22 comprises a multitude of magnetic particles 23, 24, with are directed towards the opposing wall 4, 13 with the same pole.

The coatings 19, 20 may be formed by a self-adhesive dye application which contains the magnetic particles 23, 24. The alignment of the magnetic particles 23, 24 to form magnetic elements 21, 22 takes place preferably after the application of the coatings 19, 20.

The inner part 11 can be optionally fixed in the closed position and in different opened positions through the magnetic elements 21, 22 of the coatings 19, 20. In the closed position, the inner part 11 is fixed in the outer part 2 when it is completely thrust into the outer part 2 and the cap 8 is folded closed. Further, the inner part 11 can be fixed in the outer part 2 in different opening positions, in which it is thrust out more or less of the outer part 2. A ratching sound (e.g., ratcheting) is generated upon opening and closing, due to the sliding over another of the sequence of magnetic elements 21, 22 with alternating polarity.

Figures 2A, 2B:
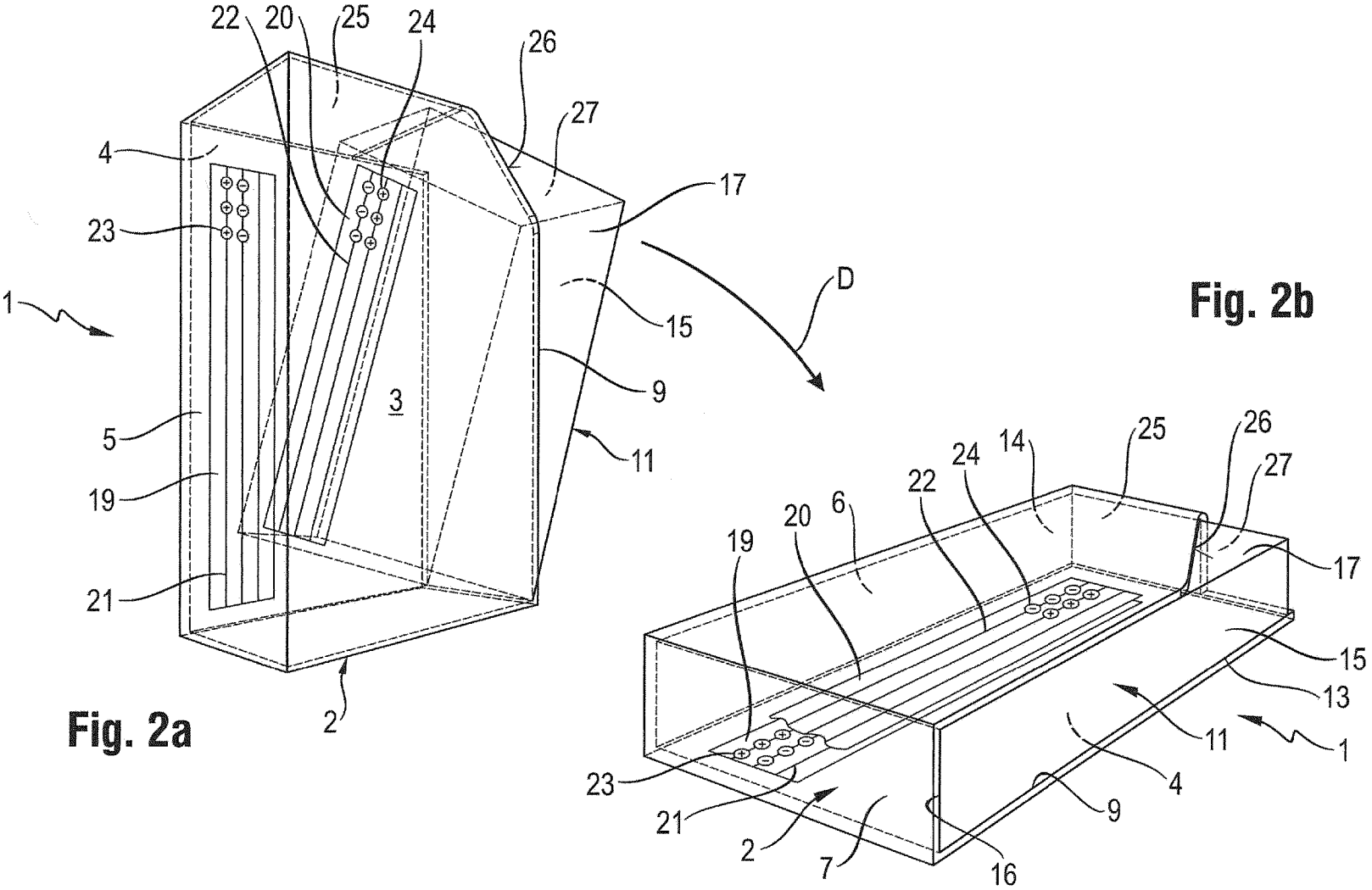
FIG. 2 a folding box with outer part and an inner part that can be folded out of the outer part, in the opened position in a perspective view from the front and from the left side (FIG. 2*a*), and in the closed position in a perspective view aslant from the front and from the right side (FIG. 2*b*)

The folding box 1 of FIG. 2 has an essentially prismatic outer part 2 with a large first front side wall 3 and a first rear side wall 4, and a narrow first left side wall 5. The outer part 2 has further a first bottom wall 7 and a first cover wall 25. On the right side, the outer part 2 has a first opening 9. Adjacent to the first opening 9, it has a chamfer 26 on the upper edge of the first front side wall 3, which is joined by the right edge of the first cover wall 25.

A drawer- or slipcase-like inner part 11 is inserted into the outer part 2. The inner part 11 has a broad second rear side wall 13 and narrow left and right side walls 14, as well as a narrow second bottom wall 16 and second cover wall 27. The inner part 11 has a second opening 17 at the front side.

The inner part 11 is pivotally connected to the outer part 2 at the lower right edge, for instance via a glue lap.

The inner part 11 is preferably filled with cigarettes, jackets or other elongate products.

Such a package is described in the documents EP 243 663, U.S. Pat. No. 3,881,599 and EP 1 863 108 in particular, which are hereby incorporated by reference in their entireties.

In addition, the inner side of the first rear side wall 4 has a first magnetic coating 19, and the outer side of the second rear side wall 13 a second magnetic coating 20. The coatings 19, 20 comprise straight or substantially straight first and second magnetic elements 21, 22. These extend vertically to the direction D in which the inner part 11 is pivotal relative to the outer part 2. The coatings 19, 20 are for example realized like the coatings 19, 20 of the realization example described above.

Due to the coatings 19, 20, the inner part 11 can be fixed in the closed position and in different opened positions. Further, the coatings 19, 20 cause a ratching (e.g., ratcheting) when the package is opened and closed.

Figure 3B:
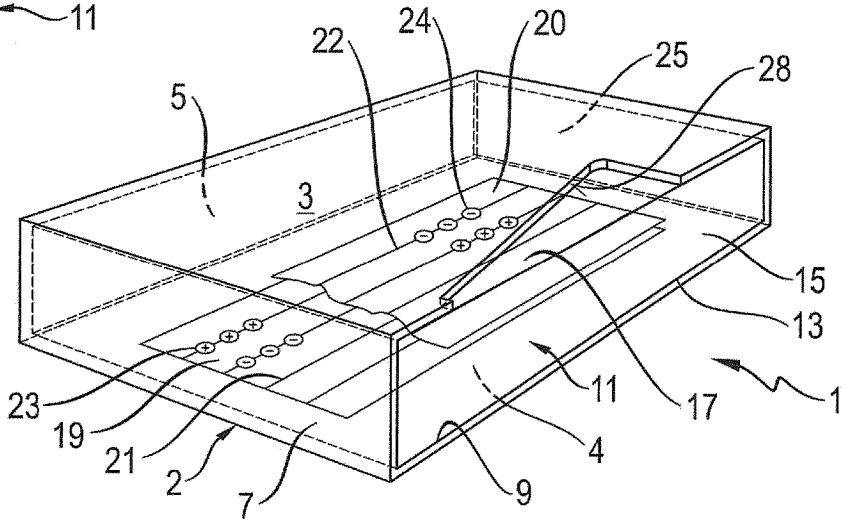
FIG. 3 a folding box with an outer part and an inner part that can be drawn out, in the opened position in a perspective view aslant from the front and from the left side (FIG. 3*a*), and in the closed position aslant from the front and from the right side (FIG. 3*b*).
Figure 3A:
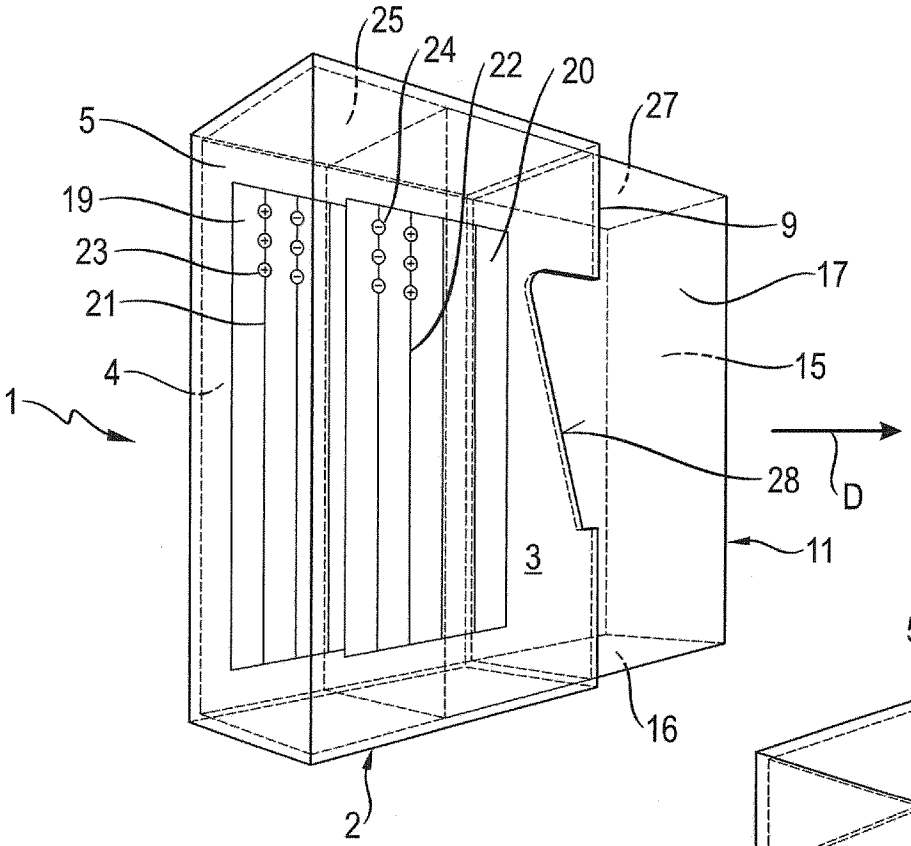

The folding box 1 of FIG. 3 differs from the above-described in that the first front side wall 3 has a wedge shaped punching 28 in the central region of its right edge. Further, the drawer- or slipcase-like inner part 11 can be drawn out of the outer part 2 in a straight drawing movement in the direction D. A folding box 1 of this kind is described in the documents U.S. Pat. No. 7,866,466 and US 2011/0147243 in particular, which are hereby incorporated by reference in their entireties.

In addition, the inner side of the first rear side wall 4 is provided with a first magnetic coating 19, and the outer side of the second rear side wall 13 with a second magnetic coating 20. The coatings 19, 20 comprise first and second straight magnetic elements 21, 22, which are aligned vertical to the direction D of the displacement of the inner part 11. The coatings are for instance realized like in the realization example of FIG. 1.

Due to the coatings 19, 20, the inner part 11 is in a closed position, and can be fixed in different opened positions. Moreover, the coatings 19, 20 cause a ratching (e.g., ratcheting) when the inner part 11 is drawn out of the outer part 2 and when it is thrust into it.

This folding box 1 is also suited for accommodating cigarettes, jackets or other elongate products in the inner part.

In all the realization examples, the outer part 2 is made of cardboard. It is preferably produced from a punched and grooved one-piece blank by folding and gluing.

Further, the inner part 11 is made of cardboard in all the realized examples. It is preferably produced from a punched and grooved one-piece blank by folding and gluing.

The invention claimed is:

1. A package for tobacco products or tobacco related commodities or smoking devices, comprising:

an openable closure with a first wall slidable over a second wall when the closure is opened and closed, the first wall includes a first sequence of magnetic elements extending in a direction of relative movement between the first wall and the second wall when the first wall slides over the second wall and having alternating positive and negative poles, wherein the first sequence of magnetic elements consists of elongate magnetic elements that are aligned crosswise to the direction of the relative movement of the two walls, and the second wall includes at least one magnetic element with a magnet pole, which slides along the magnetic elements of the first wall when the first wall slides over the second wall.

2. The package according to claim 1, wherein the magnetic elements are arranged such that the first wall and the second wall can be fixed against each other in different positions.

3. A package according to claim 1, wherein the magnetic elements are arranged such that a ratching or other audible sound is generated when the first wall slides along the second wall.

4. A package according to claim 1, wherein the second wall includes a second sequence of magnetic elements that includes the at least one magnetic element, and wherein the second sequence of magnetic elements has alternating positive and negative poles, extending in the direction of the relative movement between the first wall and the second wall when opened.

5. A package according to claim 4, wherein the second sequence of magnetic elements consists of elongate magnetic elements, which are aligned crosswise to the direction of the relative movement of the first wall and the second wall.

6. A package according to claim 1, wherein the first wall includes the sequence of magnetic elements on a side of the second wall.

7. A package according to claim 1, wherein a side of the first wall faces a side of the second wall and wherein the magnetic elements are arranged on the side of the first wall and on the side of the second wall.

8. A package according to claim 1, wherein the first wall includes a sequence of at least three magnetic elements and wherein neighbouring magnetic elements have a constantly smaller or larger distance from each other in each sequence.

9. A package according to claim 1, wherein neighbouring magnetic elements have a constant distance from each other in each sequence.

10. A package according to claim 1, wherein the first wall and the second wall include a coating that includes the magnetic elements.

11. The package according to claim 10, wherein the coating on the first wall has an adhesive bond and wherein the coating on the second wall has an adhesive bond.

12. A package according to claim 1, wherein discrete magnetic elements are bonded to the first wall and wherein discrete magnetic elements are bonded to the second wall.

13. A package according to claim 1, wherein the package is shaped like a box and further comprises a pivotal or detachable cap, the second wall connected to the pivotal or detachable cap such that the magnetic elements slide along the first wall when the box is opened.

14. A package according to claim 1, wherein the package is shaped like a box with an inner part that can be drawn out or swung out of an outer part, wherein the magnetic elements arranged on the first wall are located on the outer part and wherein the at least one magnetic element arranged on the second wall located on the inner part, such that the first wall slides along the second wall when the inner part is moved out of the outer part.

15. A package according to claim 1, wherein the packaging is shaped like a folding box.

16. A package according to claim 1, wherein the packaging is shaped like a can with a can lower part and a can lid, the can lid detachable from the lower part, wherein the magnetic elements arranged on the first wall are located on the can lower part and wherein the at least one magnetic element arranged on the second wall is located on the can lid, such that the first wall slides along the second wall upon detaching.

17. A package according to claim 1, wherein the package is made of one or more of cardboard, corrugated cardboard, plastics, and metal.

18. A package according to claim 1, wherein the openable closure is configured to be set into different positions and is fixed in the respective set positions by the magnetic elements on one or more of the first wall and the second wall.

19. A package according to claim 18, wherein opening and closing the openable closure is controlled with aid of a ratching or other sound which is generated by the magnetic elements in the walls sliding over another.

20. A package for storing products, comprising:

an openable closure with a first wall slidable over a second wall when the closure is opened and closed, the first wall includes a first sequence of magnetic elements extending in a direction of the relative movement between the first wall and the second wall when the first wall slides over the second wall, wherein the first sequence of magnetic elements consists of elongate magnetic elements that are aligned crosswise to the direction of the relative movement of the two walls and having alternating positive and negative poles, and the second wall includes a second sequence of magnetic elements with a magnet pole, which slides along the magnetic elements of the first wall when the first wall slides over the second wall.

* * * * *